United States Patent [19]

Jones

[11] Patent Number: 4,802,357

[45] Date of Patent: Feb. 7, 1989

[54] APPARATUS AND METHOD OF COMPENSATING FOR SPRINGBACK IN A WORKPIECE

[75] Inventor: Everett E. Jones, Wichita, Kans.

[73] Assignee: The Boeing Company, Seattle, Wash.

[21] Appl. No.: 54,893

[22] Filed: May 28, 1987

[51] Int. Cl.[4] ..... B21D 5/02

[52] U.S. Cl. ..... 72/389; 72/21; 72/10; 72/702; 364/476

[58] Field of Search ..... 72/10, 12, 17, 389, 72/702; 364/476

[56] References Cited

U.S. PATENT DOCUMENTS

| | | | |
|---|---|---|---|
| 3,146,819 | 9/1964 | Van Endert | 153/50 |
| 3,156,287 | 11/1964 | Munro | 153/40 |
| 3,352,136 | 11/1967 | Clarke | 72/9 |
| 3,459,018 | 8/1969 | Miller | 72/7 |
| 3,713,312 | 1/1973 | Galdabini | 72/702 |
| 3,821,525 | 6/1974 | Eaton et al. | 235/151.1 |
| 3,854,215 | 12/1974 | Foster | 33/174 |
| 3,943,746 | 3/1976 | Eitel et al. | 72/702 |
| 3,955,389 | 5/1976 | Foster | 72/9 |
| 4,131,008 | 12/1978 | Malatto | 72/309 |
| 4,408,471 | 10/1983 | Gossard et al. | 72/389 |
| 4,511,976 | 4/1985 | Graf | 364/474 |
| 4,564,765 | 1/1986 | Blaich | 72/389 |

FOREIGN PATENT DOCUMENTS

| | | | |
|---|---|---|---|
| 0166351 | 1/1986 | European Pat. Off. | 72/702 |
| 2072551A | 10/1981 | United Kingdom . | |

OTHER PUBLICATIONS

"An Adaptive Pressbrake Control Using an Elastic--Plastic Material Model," Journal of Engineering for Industry, vol. 104/389, Nov. 1982.

"Sequential Forming of Sheet Metal Parts," Rept. No. AFWAL-TR-80-4056, Massachussets Institute of Technology, Laboratory for Manufacturing and Productivity, report covering work conducted from 6/1/78 to 8/31/79.

*Primary Examiner*—David Jones

*Attorney, Agent, or Firm*—Finnegan, Henderson, Farabow, Garrett & Dunner

[57] ABSTRACT

An apparatus and a method for bending a workpiece to a predetermined angle in a brake press and automatically compensating for springback of the workpiece which has a sensing device, biased relative the workpiece, for detecting a neutral position of the workpiece corresponding to the cessation of springback motion and generating a signal in response thereto, and a device, responsive to the signal, for measuring the linear distance of springback, and for calculating an amount of overbend required to compensate for springback based on said measured linear distance of springback and the physical geometry of the workpiece. Preferably, the sensing devcie having a linear variable differential transformer having a core rod biased toward the workpiece and in opposition to the punch member of the brakepress.

7 Claims, 5 Drawing Sheets

FIG. 2
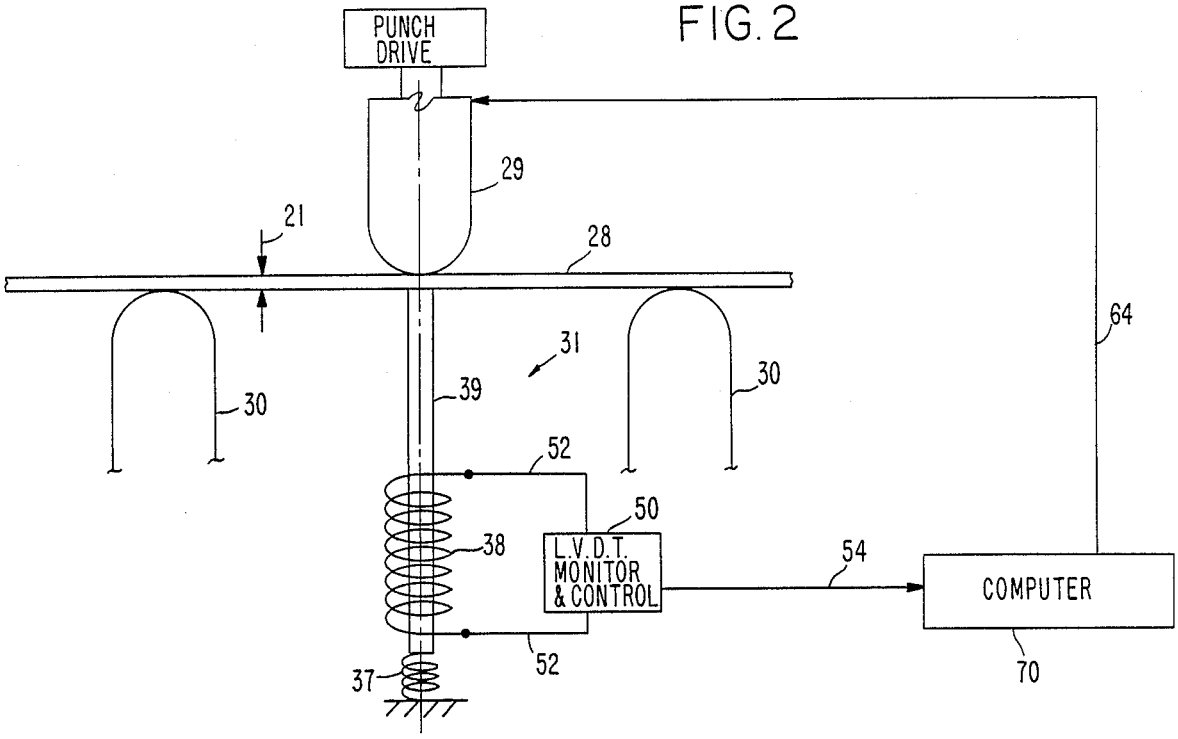
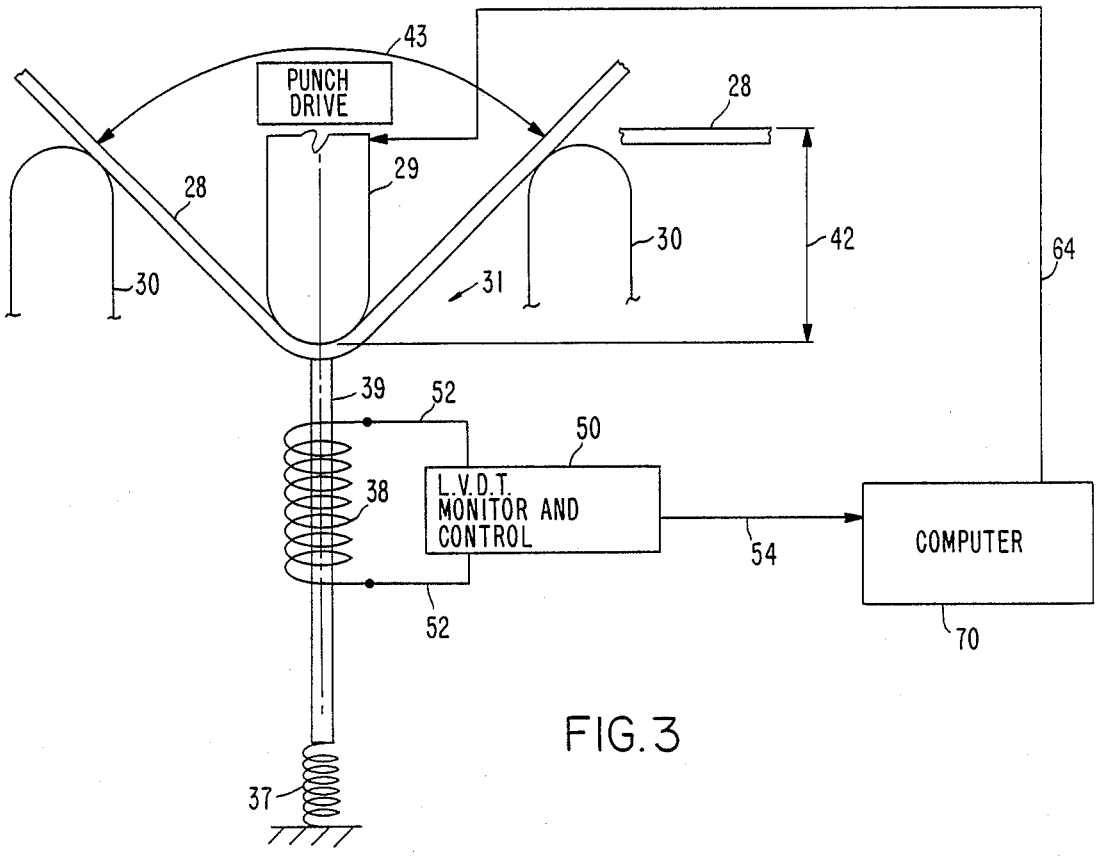
FIG. 3

APPARATUS AND METHOD OF COMPENSATING FOR SPRINGBACK IN A WORKPIECE

BACKGROUND OF THE INVENTION

1. Field of the Invention

The present invention relates to an air die type brake press for bending a workpiece to a predetermined angle, and more particularly to a brake press which automatically compensates for springback in the workpiece by determining the overbend required to compensate for springback.

2. Description of the Related Art

In prior art brake presses, the punch penetration into the die to form the selected bend angle is estimated and a test part is bent. The angle of bend is then checked, and punch penetration is reset and the workpiece is bent again. This process is repeated until the correct angle of bend is produced in the workpiece.

The repetitive process of punch penetration into the die to form the selected bend angle in the workpiece is necessitated due to the elastic properties of the workpiece causing the workpiece to springback after being bent.

Significant advantages are available if the trial and error method of determining the proper punch penetration to achieve the selected bend angle can be eliminated. Potential benefits from eliminating this trial and error method include reduced setup time, improved quality control, insensitivity to material property variations, and improved operator safety. It has been estimated that cost savings during set-up alone can approach 18 percent if a suitably reliable method of automatically compensating for springback can be achieved.

Numerous studies have been conducted in an attempt to eliminate the trial and error method of forming angles in workpieces. Typical of these studies is one entitled "An Adaptive Pressbrake Control Using an Elastic-Plastic Material Model," *Journal of Engineering for Industry,* Volume 104, page 389, November, 1982, by K.A. Stelson and D.C. Gossard. This article was derived from a United States Air Force laboratory test program conducted at the Laboratory for Manufacturing and Productivity, Massachusetts Institute of Technology, entitled "Sequential Forming of Sheet Metal Parts," Report No. AFWAL-TR-80-4056. The authors designed and built a controller for an air die type brake press which measured force and displacement during the early part of the bend cycle to estimate workpiece parameters. These parameters were then used in an elastic-plastic material model to predict the correct final punch penetration to yield the desired unloaded angle after springback.

The brake press developed as a result of the research under the Air Force test program noted above, included an angle transducer which directly measured the angle of bend between the workpiece and the die of the brake press. The angle transducer was used to determine the difference between the desired angle of bend in the workpiece and the angle of bend of the workpiece after springback. This difference was then added to the initial desired bend angle and the workpiece was rebent to the new angle and the angle of bend after springback was again measured by the angle transducer. This repetitive process was continued until the angle of the workpiece after springback, i.e., the unloaded angle, matched the desired angle of bend.

The report referred to above noted significant drawbacks with respect to determining the unloaded bend angle by means of the angle transducer. The angle transducer consisted of a spring biased pin projecting through a cylindrical hole in the die member of a brake press. One end of the pin contacted the workpiece surface, and the other end was connected to a rotary shaft encoder offset from the die member of the brake press. Using the angle transducer described above to directly measure the angle of springback in a workpiece has significant drawbacks in that when used in an industrial environment a second solenoid is required to withdraw the pin below the surface of the die when loading the workpiece on the brake press. Moreover, each die set would require its own built-in angle transducer which would have to be recalibrated regularly.

Therefore, it is an object of the present invention to provide a means for quickly and accurately determining the cessation of springback motion in a workpiece in order to initiate a sequence of calculations to determine the amount of overbend required to compensate for springback.

It is a further object of the present invention to provide an apparatus and a method for determining the angle of springback in a workpiece, to thereby calculate the amount of overbend required to compensate for springback, which does not require a direct measurement of the angle of bend in the workpiece.

It is still a further object of the present invention to provide a means for determining the amount of overbend required to compensate for springback in a workpiece which can be quickly mounted and dismounted on different brake presses.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

To achieve the object and in accordance with the purpose of the invention, as embodied and broadly described herein, there is provided a die press for bending a workpiece to a selected angle, comprising: a pair of spaced die members for supporting the workpiece while the workpiece is being bent therebetween; a punch member, and means for moving the punch member in a first direction to penetrate between the spaced die members to bend the workpiece therebetween, and for moving the punch member in a second direction, opposite the first direction, to permit the workpiece to springback; means, positioned in opposition to the punch member, for sensing a neutral position of the workpiece corresponding to the cessation of springback motion in the workpiece, and for generating a signal in response thereto, the means for moving the punch member being responsive to the signal to cease movement of the punch member in the second direction. The die press further includes means, responsive to the signal generated by the sensing means, for determining the linear distance of springback in the workpiece corresponding to the distance the punch member moves in the second direction; and means for calculating, based on the linear distance of springback and the physical geometry of the brake press, an amount of overbend required to compensate for springback.

Preferably, the die press further includes means for selectively activating the sensing means when movement of the punch member changes from the first direction where the punch penetrates between the die members to bend the workpiece, to the second direction where the workpiece springs back.

BRIEF DESCRIPTION OF THE DRAWINGS

The accompanying drawings, which are incorporated in and constitute a part of this specification, illustrate an embodiment of the invention and the steps of the method for practicing the invention, and together with the description, serve to explain the principles of the invention.

FIG. 2 is a schematic representation of a die press incorporating the present invention with a workpiece inserted thereon;

FIG. 3 is a schematic representation of a die press incorporating the present invention with the workpiece formed to a selected angle;

DESCRIPTION OF THE PREFERRED EMBODIMENT

Reference will now be made in detail to the present preferred embodiment of the invention and the method for practicing the same, an example of which is illustrated in the accompanying drawings.

Figure 1:
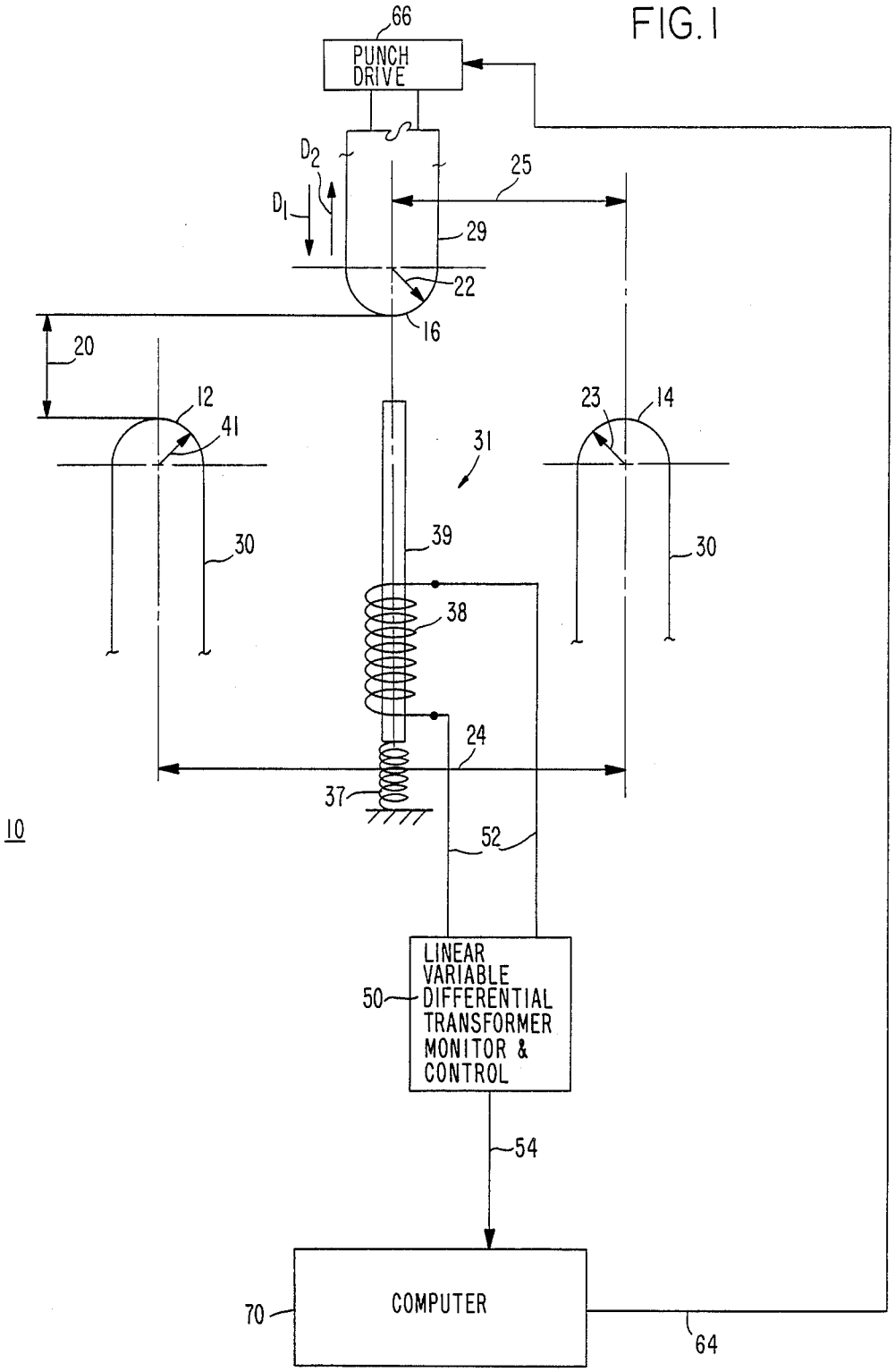
FIG. 1 is a schematic representation of a die press incorporating the present invention.

The preferred embodiment of the die press incorporating the instant invention is illustrated in FIGS. 1 and 2 and broadly represented by the numeral 10. In accordance with the invention, there is provided a punch member 29 and a means for moving the punch member 29 in a first direction D1 to bend a workpiece 28 to a predetermined angle between a pair of spaced die members 30, and for moving punch member 29 in a second direction D2 to permit workpiece 28 to springback. As embodied herein, the means for moving punch member 29 includes punch drive 66 and computer controller 70. After bending the workpiece 28 between die members 30, punch member 29 is moved in a second direction D2 opposite the first direction D1. The die members 30 have rounded top portions 12 and 14 with known radii of curvature 41 and 23, respectively. Punch 29 has a rounded head portion 16 having a known radius of curvature 22. The axial center lines of die members 30 are separated by a distance 24 and punch member 29 has an axial center line equidistant from and coplanar with the axial center lines of punch members 30. The centerline of punch member 29 and the center line of die members 30 are separated by a distance 25.

The brake press of the present invention includes means for sensing when the workpiece achieves a neutral position corresponding to the cessation of springback motion in the workpiece, and generating a signal in response to the cessation of springback motion. As embodied herein, the sensing means includes a linear variable differential transformer having a coil 38 and a movable core rod 39. Core rod 39 is positioned coaxially and in opposition with punch member 29 and is biased toward workpiece 28 by a spring 37, and coil 38 is stationary relative to the core rod 39. As embodied herein, the sensing means further includes a linear variable differential transformer monitor and controller 50 connected to coil 38 by lead lines 52. A variable voltage is produced in the coil 38 as the core rod 39 moves relative to the coil. When the core rod 39 is stationary relative the coil 38, after following workpiece 28 through springback, there is produced a constant voltage in the coil corresponding to a neutral position of the workpiece and the cessation of springback motion. The monitor and controller 50 senses the voltage in the coil 38 via lines 52 and generates a signal in response to sensing a constant voltage. The signal is transmitted to computer controller 70 via lead line 54. Computer 70 governs the speed of withdrawal of punch member 29 in direction D2 in accordance with the decreasing voltage change sensed by linear variable differential transformer 50. Upon receiving a signal corresponding to no voltage change, i.e., constant voltage, in transformer 50, computer 70 generates and sends a signal via lead line 64 to punch drive 66 to stop movement of punch member 29 in direction D2.

In accordance with the instant invention there is provided a means, responsive to the signal generated by the sensing means, for determining the linear distance of springback in the workpiece. As embodied herein, the means for determining the linear distance of springback includes computer 70 and punch drive 66. Computer 70 controls the movement and constantly monitors the position of punch member 29 between die members 30. After punch 29 has penetrated between the die members in the direction D1 the necessary distance to form the predetermined angle in the workpiece, computer 70 signals punch drive 66 to move punch member 29 in a direction D2 and monitors and records the distance punch member 29 is moved in the second direction D2. Upon receiving the signal from controller 50 that workpiece 28 has achieved a neutral position corresponding to cessation of springback motion, computer 70 records the position of punch 29 and determines the distance the punch member 29 has moved in the second direction D2. This distance corresponds to the linear distance of springback in the workpiece.

The step of determining the linear distance of springback is not limited to measuring the distance punch member moves in the second direction D2. Alternatively, the linear distance of springback may also be determined by directly monitoring with computer 70 the distance core rod 39 moves in direction D2 after punch member 29 bends the workpiece. Since core rod 39 is biased toward the workpiece 28, movement of the workpiece is directly translated to movement of the core rod, and the linear distance of springback can be determined by monitoring the position of core rod 39. Alternatively, the distance core rod 39 moves in direction D2 may be determined in accordance with the absolute change in voltage across the coil 38 since the change in voltage across the coil 38 is proportional to the movement of the rod 39 through the space defined by the coils 38.

In the preferred embodiment illustrated in FIG. 1, computer 70 may also provide means for generating a signal, when movement of punch member 29 changes from first direction D1 to second direction D2, to selectively activate transformer monitor 50. Thus, transformer monitor 50 may be selectively activated to monitor the voltage output of coil 38 when core rod 39, biased toward workpiece 28, moves with workpiece 28 through springback. In this manner, computer 70 will monitor the distance punch member 29 or core rod 39 moves in direction D2 only during springback of the workpiece and not during other segments of the punch penetration and retraction cycle. This selective activation of transformer monitor 50 ensures that spurious signals are not generated by monitor 50 when the workpiece is in a neutral position other than the neutral position achieved upon cessation of springback motion.

In accordance with the invention there is next calculated, based on the linear distance of springback and the physical geometry of the brakepress, the amount of overbend necessary to achieve a predetermined angle of bend in workpiece 28 after springback. As embodied herein, the means for calculating the necessary overbend includes computer 70. Computer 70 calculates the necessary amount of overbend based on the linear distance of springback, which corresponds to the distance punch member 29 is moved in second direction D2, and the physical geometry of the brake press. To compensate for springback on subsequent bends, computer 70 adds the calculated amount of overbend to the initial distance punch member 29 moves in direction D1, and then causes punch member 29 to overbend the workpiece by the calculated amount.

Figure 4:
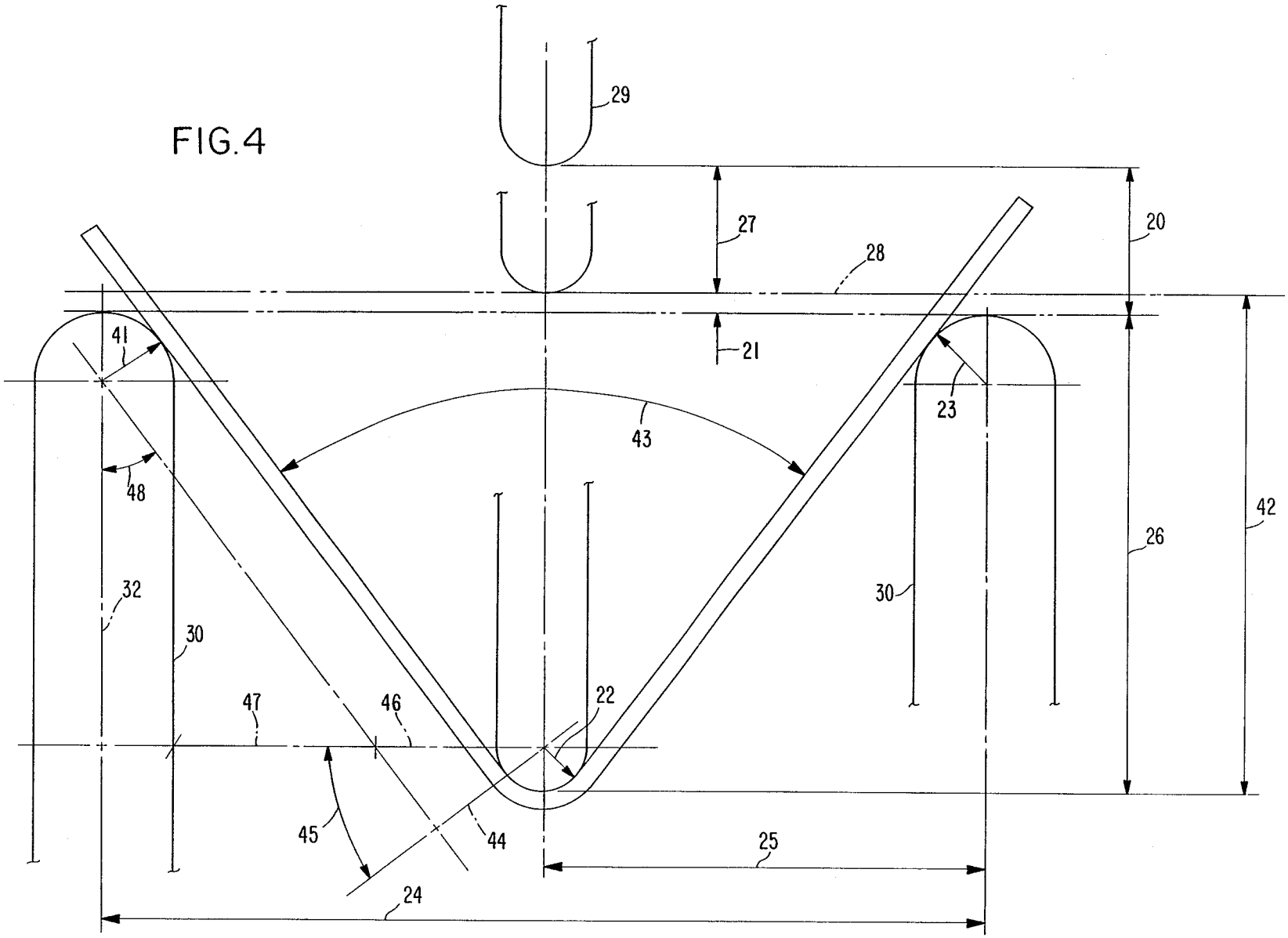
FIG. 4 is a schematic representation of the die press illustrating the physical dimensions required to calculate the angle of bend of the workpiece.

The operation of the preferred embodiment of the present invention will now be described in detail with reference to Figs. 1-5. Workpiece 28, having a thickness 21, is placed on the dies 30 forcing the core rod 39 of linear variable differential transformer 38 into spring biased contact with the lower surface of the workpiece. The punch 29 is then lowered a distance equal to the open height 20, as shown in FIG. 1, minus the workpiece thickness 21. Thus, the punch 29 is brought into contact with the upper surface of workpiece 28. An angle of bend 43 is selected and a distance of penetration 42 of punch 29 between the die members 30 is calculated by computer 70 to achieve the selected angle of bend. With reference to FIG. 4, computer 70 calculates the distance 42 which the punch must penetrate between the die members to form the angle 43 knowing the selected angle of bend 43, the distance 25 between the axial centerlines of the punch member 29 and die members 30, and the radii 41, 23 and 22 of the rounded top portions 12, 14 and 16, respectively.

Figure 5:
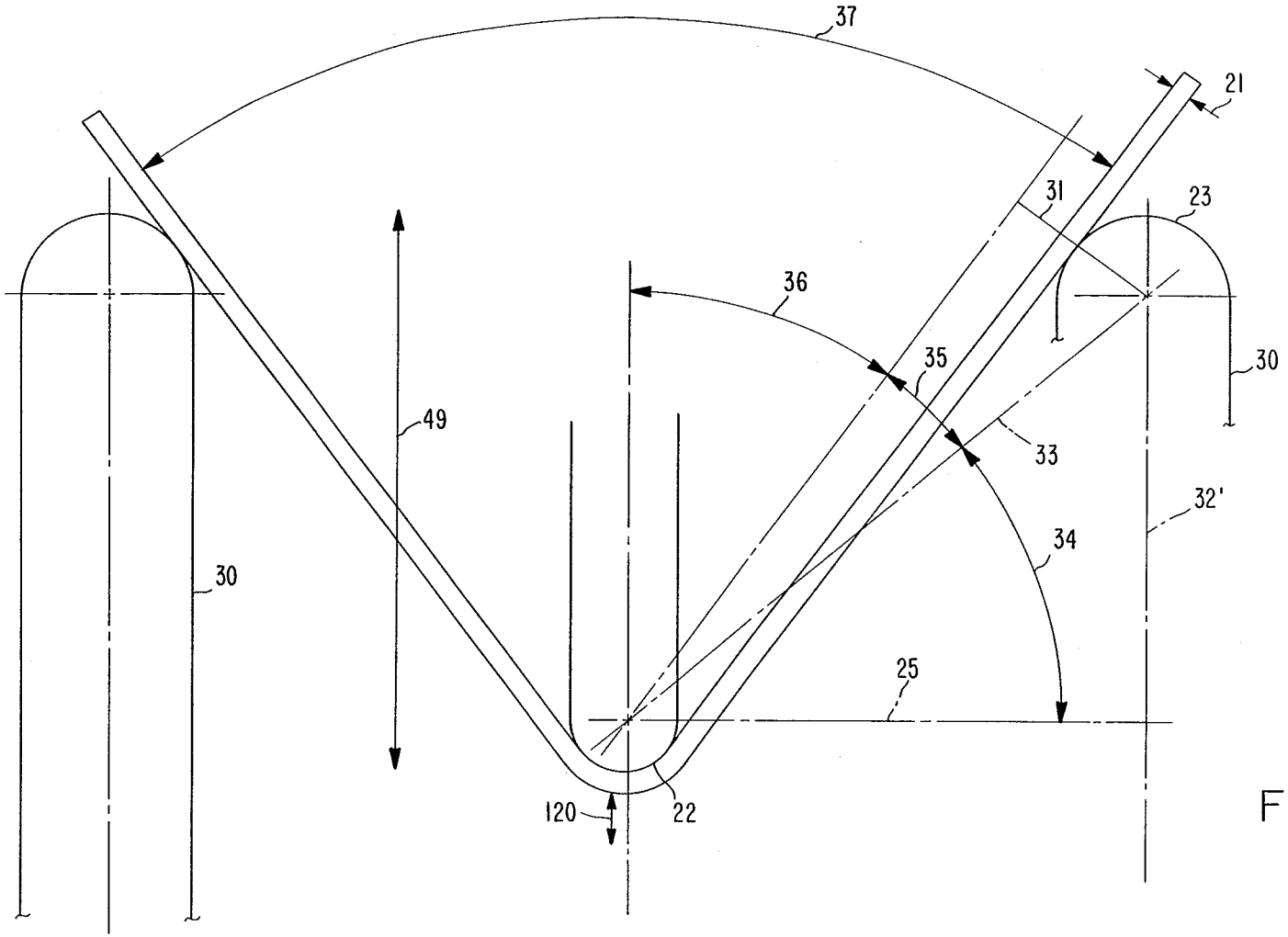
FIG. 5 is a schematic representation of the die press illustrating the configuration and dimensions of the workpiece after springback motion has ceased.

With reference to FIG. 1 and FIG. 5, a drive force is applied to punch member 29 by punch drive 66 and the punch member is moved in direction D1 the distance 42 to bend the workpiece. The drive force applied to punch member 29 is then relaxed and punch drive 66 moves punch member 29 in direction D2 allowing workpiece 28 to spring back. Computer 70 senses the change in direction of the punch member 29 from the first direction D1 to the second direction D2 and transmits a signal via line 54 to activate linear variable differential transformer monitor 50. As punch member 29 is moved in direction D2, core rod 39, biased toward workpiece 28, moves relative to the coil 38 as the workpiece moves through springback. This motion of core rod 39 relative coil 38 generates a changing output voltage which is sensed by monitor 50. At the cessation of springback motion in the workpiece 28, the core rod 39 will be stationary relative coil 38 and monitor 50 will sense a constant output voltage. Upon sensing the constant output voltage, computer 70 signals punch drive 66 to cease withdrawal of punch member 29 in direction D2. The retraction distance 120, shown in FIG. 5, of punch member 29 in direction D2 represents the linear distance of springback in the workpiece. Computer 70 monitors and records the position of punch member 29 as it moves in direction D2. Computer 70 then records the final distance punch member 29 has moved in direction D2 and initiates a sequence of calculations based on the distance punch member 29 has moved in direction D2, and the physical geometry of brakepress 10, to calculate the required amount of overbend to compensate for springback.

Various formulas have been developed to determine the amount of overbend required to compensate for springback based on a known angle of springback in the workpiece. Knowing the retraction distance 120, and hence the linear distance of springback in workpiece 28, the angle of springback can be determined. With reference to FIGS. 4 and 5, the angle of springback is calculated by computer 70. Knowing the depth of penetration 42 of the punch member in the direction D1, and retraction distance 120, the depth of penetration of the punch member 29 after springback can be calculated and is represented by 32 in FIG. 5. Knowing the dimension 32 and the dimension 25, the distance 33 and the angle 34 can be calculated. Then, knowing the distance 33 and the distance 31, which is equal to the sum of radii 22 and 23, the angle of spring back 35 can be calculated.

The angle of springback 35 is inserted by computer 70 in preprogrammed empirical formulas to calculate the amount of overbend required to compensate for springback. Examples of these empirical formulas are provided in the Air Force Laboratory for Manufacturing and Productivity, Report No. AFWAL-TR-80-4056.

As herein described, the instant invention provides a means of determining the amount of overbend required to compensate for springback which can be easily and quickly mounted on many different die sets. The transformer coil 38 and core rod 39 can be made as a single unit and easily inserted in a brake press directly below the punch member. This unit could then be coupled with control circuitry of a respective brake press to thereby determine the amount of overbend required to compensate for springback in the manner previously described.

Figure 6:
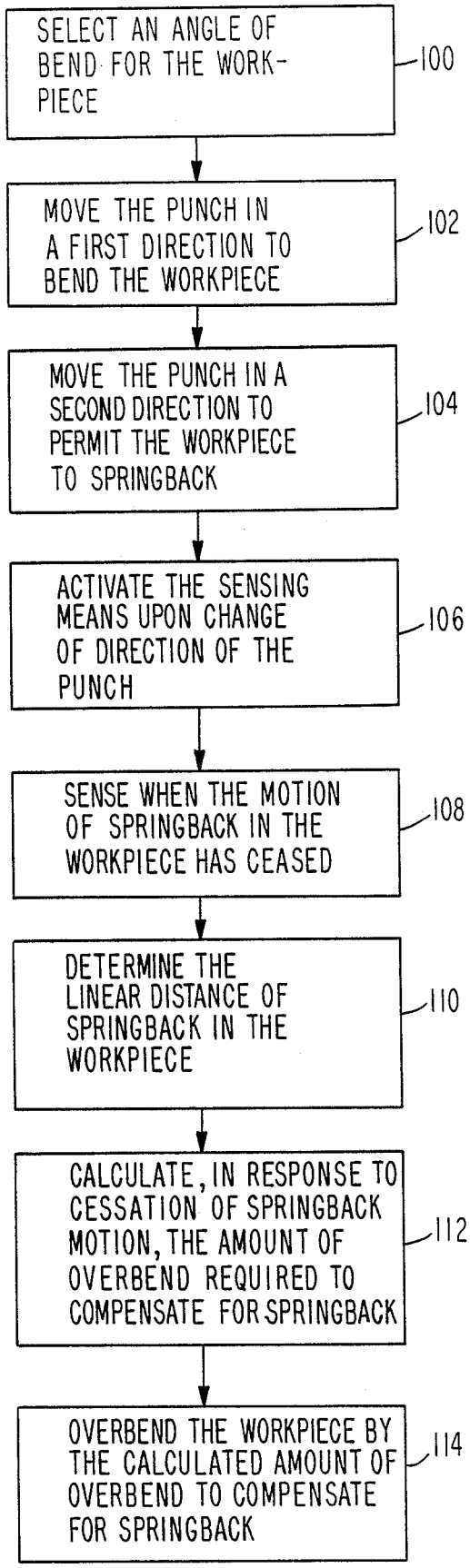
FIG. 6 is a block diagram illustrating the steps of the method for determining the amount of overbend required to compensate for springback in a workpiece.

FIG. 6 is a flowchart of the steps necessary to practice the method of the instant invention. At step 100, an angle of bend for the workpiece is selected. At step 102 the punch is moved in the first direction to bend the workpiece. At step 104 the punch is moved in a second direction, opposite the first direction, to permit the workpiece to springback. At step 106 the means for sensing cessation of springback motion is activated upon the change of direction of the punch member from the first to the second direction. At step 108 the sensing means senses when the motion of springback in the workpiece has ceased. At step 110 the linear distance of springback in the workpiece is determined which corresponds to the distance the punch member moves in the second direction. At step 112 a sequence of calculations is initiated, based on the linear distance of springback and the physical geometry of the brakepress, to calculate the amount of overbend necessary to achieve the predetermined angle of bend in the workpiece after springback. At step 114 a workpiece is overbent by moving the punch member in the first direction a linear distance equal to the calculated amount of overbend plus the distance the punch was initially moved in the first direction.

Additional advantages and modifications will readily occur to those skilled in the art. The invention in its broader aspect is, therefore, not limited to the specific details, representative apparatus an illustrative example shown and described. Accordingly, departures may be made from such details without departing from the spirit or scope of applicant's general inventive concept.

What is claimed is:

1. A method of bending a workpiece to a predetermined angle in a brakepress, wherein springback of the workpiece is automatically compensated for by overbending the workpiece by a calculated amount, comprising the steps of:

moving a punch member a selected distance in a first direction to bend the workpiece between a pair of spaced die members to a predetermined angle;

moving the punch member in a second direction, opposite the first direction to permit springback of the workpiece;

sensing when the workpiece achieves a neutral position corresponding to the cessation of springback motion in the workpiece;

determining, in response to sensing the cessation of springback motion, the distance the punch member moves in said second direction, said distance corresponding to the linear distance of springback of the workpiece;

calculating, based on said linear distance of springback and the physical geometry of the brakepress, an amount of overbend necessary to achieve said predetermined angle of bend in the workpiece after springback; and moving said punch member in the first direction a distance sufficient to overbend the workpiece by said calculated amount.

2. The method of claim 1, wherein said step of sensing the cessation of springback motion includes the substep of selectively activating a means for sensing a neutral position of said workpiece when the movement of said punch member changes from said first direction to said second direction.

3. A brake press for bending a workpiece to a predetermined angle, wherein springback of the workpiece is automatically compensated for by overbending the workpiece by a calculated amount, comprising:

a pair of spaced die members for supporting said workpiece while said workpiece is being bent therebetween;

a punch member, and means for moving said punch member in a first direction into said cavity to bend said workpiece, and for moving said punch member in a second direction, opposite said first direction, to permit said workpiece to springback;

means, positioned in opposition to said punch member, for sensing the speed of movement of said workpiece in said second direction during springback thereof, for sensing a neutral position of said workpiece corresponding to the cessation of springback motion in the workpiece, and for generating signals in response thereto, said sensing means being biased toward said workpiece and said means for moving the workpiece being responsive to said signals to cease movement of said punch member in said second direction;

means for controlling the speed of movement of said punch member in said second direction in accordance with said signals generated by said sensing means; and means, responsive to the signal generated by said sensing means, for determining the linear distance of springback in said workpiece corresponding to the distance said punch member moves in said second direction, and calculating, based on said linear distance of springback and the physical geometry of said brakepress, an amount of overbend required to achieve said predetermined angle of bend in said workpiece after springback.

4. The brakepress of claim 3, further including means for generating a signal when movement of said punch member changes from said first direction to said second direction, said signal to selectively activate said means for sensing the neutral position of said workpiece.

5. The die press of claim 3, wherein said sensing means comprises a linear variable differential transformer having a movable cord rod axially biased toward said workpiece.

6. The die press of claim 5, wherein said means for determining the linear distance of springback includes means for measuring the distance of said punch member moves in said second direction.

7. The die press of claim 5, wherein said means for determining the linear distance of springback includes means for monitoring and recording the position of said core rod.

* * * * *